US007506783B2

(12) United States Patent
Brennan et al.

(10) Patent No.: US 7,506,783 B2
(45) **Date of Patent: *Mar. 24, 2009**

(54) DUAL FLUID CARTRIDGE ASSEMBLY

(75) Inventors: Robert C. Brennan, Bordentown, NJ (US); Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 195 days.

This patent is subject to a terminal disclaimer.

(21) Appl. No.: 10/537,012

(22) PCT Filed: Jun. 9, 2003

(86) PCT No.: PCT/US03/17997

§ 371 (c)(1),
(2), (4) Date: May 31, 2005

(87) PCT Pub. No.: WO2005/005305

PCT Pub. Date: Jan. 20, 2005

(65) Prior Publication Data

US 2006/0144858 A1 Jul. 6, 2006

(51) Int. Cl.
*B67D 5/52* (2006.01)

(52) U.S. Cl. ..... 222/137; 222/327; 222/386; 222/481.5

(58) Field of Classification Search ..... 222/135–137, 222/95, 105, 326–327, 145.6, 386, 386.5, 222/391, 481.5, 145.1, 251
See application file for complete search history.

(56) References Cited

U.S. PATENT DOCUMENTS 2,754,490 A 7/1956 Cohen
3,370,754 A 2/1968 Cook et al.
3,380,451 A 4/1968 Porter et al.
3,437,242 A 4/1969 Poitras
3,477,431 A 11/1969 Walecka
3,595,439 A 7/1971 Newby et al.

(Continued)

FOREIGN PATENT DOCUMENTS

DE 19744746 4/1999

(Continued)

OTHER PUBLICATIONS

D. Jelercic, "European Search Report", Apr. 18, 2006, 3 pages.

(Continued)

*Primary Examiner*—Frederick C. Nicolas
(74) *Attorney, Agent, or Firm*—Wood, Herron & Evans, L.L.P.

(57) ABSTRACT

A dual fluid cartridge assembly (30) is adapted to be used with a conventional caulking gun (20). The dual fluid cartridge assembly includes an outer cartridge (32), a piston seal and delivery tube (36), an upper piston seal (38) and an inner cartridge (34). The outer cartridge includes a cartridge outlet (40) for dispensing fluids and as configured to accept conventional mixing nozzles. Fluids are back-filled through the cartridge outlet into the inner cartridge and the outer cartridges. In order to prevent trapped air pockets during the filling of the fluid in the inner cartridge, one or more slots (54) are formed in a base plate (42) of the inner cartridge.

10 Claims, 7 Drawing Sheets

U.S. PATENT DOCUMENTS

| | | | | |
|---|---|---|---|---|
| 3,678,931 | A | | 7/1972 | Cohen |
| 3,682,174 | A | | 8/1972 | Cohen |
| 3,684,136 | A | | 8/1972 | Maumann |
| 3,760,503 | A | | 9/1973 | Baskas |
| 3,885,710 | A | | 5/1975 | Cohen |
| 4,014,463 | A | | 3/1977 | Hermann |
| 4,029,236 | A | | 6/1977 | Carson et al. |
| 4,159,570 | A | | 7/1979 | Baskas et al. |
| 4,220,261 | A | * | 9/1980 | White ..... 222/135 |
| 4,538,920 | A | | 9/1985 | Drake |
| 4,648,532 | A | | 3/1987 | Green |
| 4,771,919 | A | | 9/1988 | Ernst |
| 4,941,751 | A | | 7/1990 | Muhlbauer |
| 4,969,747 | A | | 11/1990 | Colin et al. |
| 4,986,443 | A | | 1/1991 | Saur et al. |
| 5,058,770 | A | | 10/1991 | Herold et al. |
| 5,172,807 | A | | 12/1992 | Dragan et al. |
| 5,242,091 | A | | 9/1993 | Ishida et al. |
| 5,310,091 | A | | 5/1994 | Dunning et al. |
| 5,400,926 | A | | 3/1995 | Keller |
| 6,048,201 | A | | 4/2000 | Zwingenburger |
| 6,116,900 | A | | 9/2000 | Ostler |
| 6,328,715 | B1 | | 12/2001 | Dragon et al. |
| 6,398,761 | B1 | | 6/2002 | Bills et al. |
| 6,454,129 | B1 | | 9/2002 | Green |
| 6,634,524 | B1 | | 10/2003 | Helmenstein |
| 6,652,494 | B1 | | 11/2003 | Dragan et al. |
| 6,843,652 | B2 | | 1/2005 | Xie et al. |
| 6,848,480 | B2 | | 2/2005 | Brennan |
| 6,869,419 | B2 | | 3/2005 | Dragan et al. |

FOREIGN PATENT DOCUMENTS

| | | |
|---|---|---|
| DE | 10132417 | 1/2003 |
| FR | 2418173 | 9/1979 |
| WO | WO 2005/005305 | 1/2005 |
| WO | WO2005005305 | 1/2005 |

OTHER PUBLICATIONS

M. Eberwein, "European Search Report", Aug. 19, 2005, 3 pages.
L. Appelt, "Supplementary European Search Report", Jun. 14, 2006, 3 pages.

* cited by examiner

Fig. 2
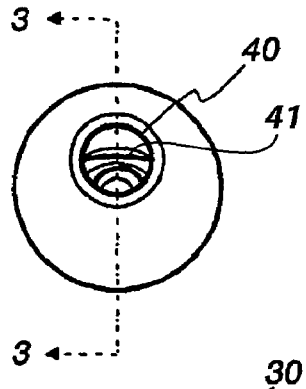
Fig. 3
(FILLED)
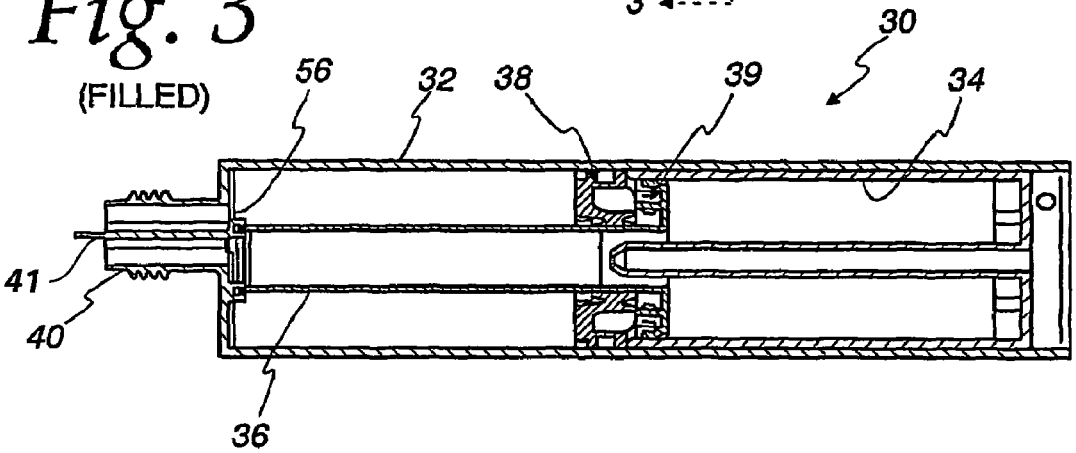
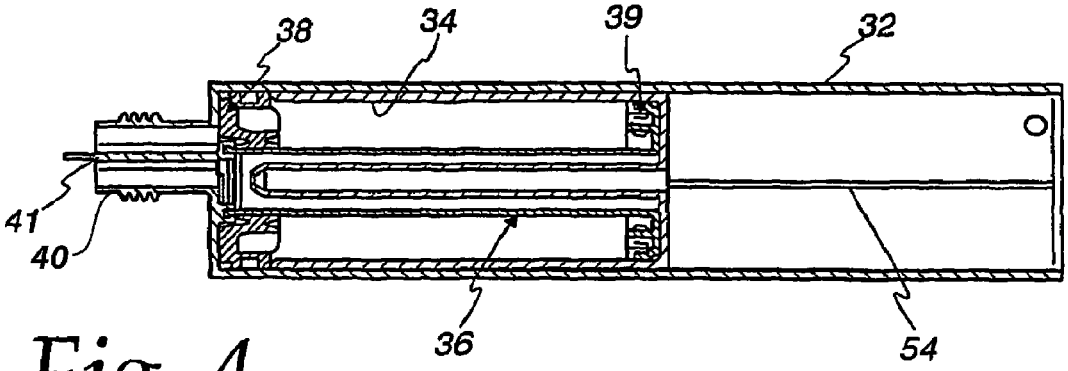
Fig. 4
(EMPTY)
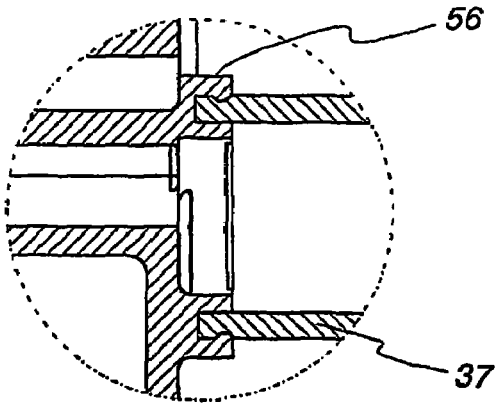
Fig. 5

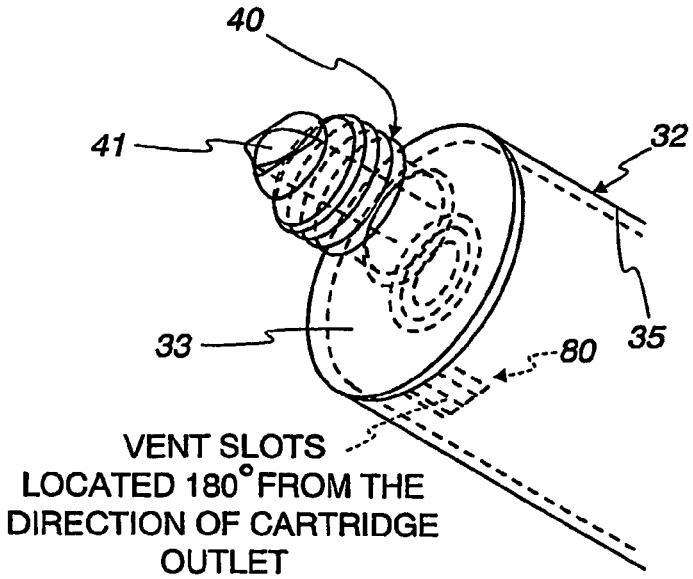
Fig. 18
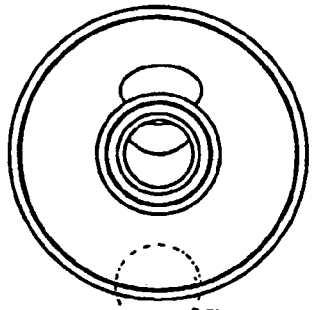
Fig. 19
OUTER CARTRIDGE
VIEW, FROM
THE OPEN END
DETAIL
Fig. 20
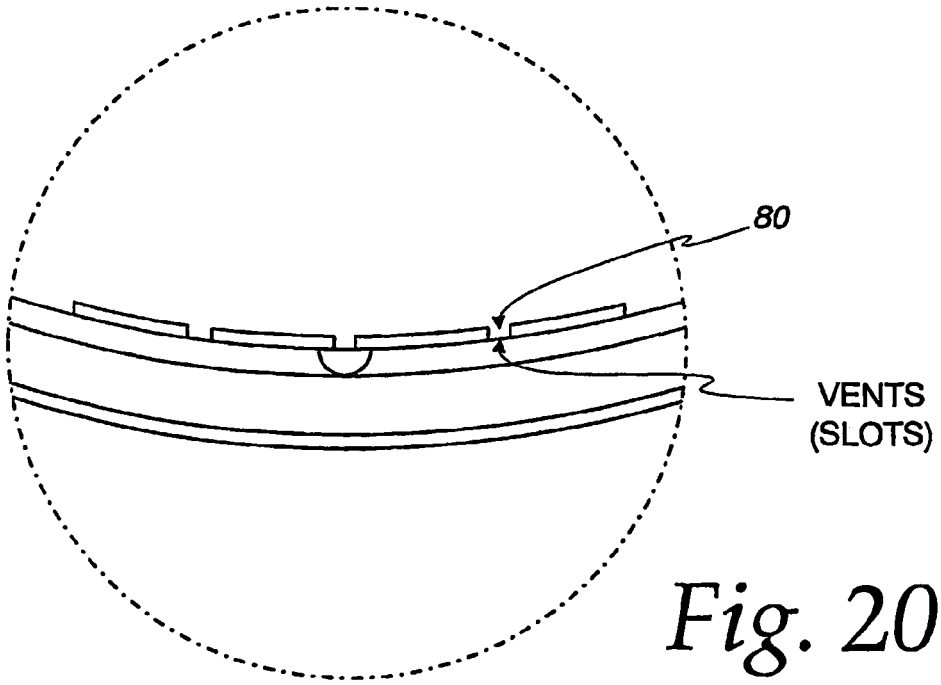
Fig. 20

DUAL FLUID CARTRIDGE ASSEMBLY

BACKGROUND OF THE INVENTION

1. Technical Field

The present invention relates to a dual fluid cartridge assembly and more particularly to a dual fluid cartridge assembly configured with an air vent for evacuating air during filling of the cartridge to eliminate trapped air pockets in the fluid to be dispensed.

2. Description of the Prior Art

Fluid cartridge assemblies are generally known in the art Both single and multiple fluid cartridge assemblies are known. An example of a single fluid cartridge assembly is disclosed in commonly owned international patent application No. PCT/US02/39041, filed on Dec. 6, 2002. Such a single fluid cartridge assembly is used to dispense a single fluid.

Dual fluid cartridge assemblies are also known. Examples of such dual fluid cartridge assemblies are disclosed in U.S. Pat. Nos. 4,220,261; 4,961,520; and 5,310,091. Such dual fluid cartridge assemblies are known to be used to dispense fluid materials, such as thermoset adhesives, which typically contain two components that need to remain separated and applied quickly after mixing. U.S. Pat. No. 5,310,091 discloses a dual fluid cartridge assembly configured with a front and rear chamber formed by an inner cartridge and an outer cartridge, respectively. Piston seals are used to separate the fluids within the cartridges. Movement of the inner cartridge, for example, under the influence of a plunger in a conventional caulking gun, causes the inner cartridge and upper piston to advance axially within the outer cartridge. The inner cartridge is in fluid communication with a hollow delivery tube which extends through a front chamber up to a cartridge outlet. Movement of the inner cartridge within the outer cartridge causes fluids in the inner cartridge and outer cartridge to be dispensed.

One problem associated with such dual fluid cartridge assemblies occurs during the fluid filling process. In particular, filling is initiated by forcing as much air as possible out of the inner and outer cartridge chambers prior to filling. The inner and outer cartridges are then back-filled with a fluid through the cartridge outlet Unfortunately, this method traps a quantity of air in both the inner and outer cartridge chambers. The trapped air forms air pockets in the fluid and causes many undesirable affects, such as non-uniform application of the fluids, as well as drooling after the fluid has been dispensed. In addition, trapped air bubbles in the final mixed product are known to provide unsatisfactory results of the dispensed fluids. Thus, there is a need for a dual fluid cartridge assembly which evacuates air during filling in order to prevent trapped air pockets within the fluid to be dispersed.

SUMMARY OF THE INVENTION

Briefly, the present invention relates to a dual fluid cartridge assembly adapted to be used with a conventional caulking gun. The dual fluid cartridge assembly includes an inner cartridge, a piston seal and delivery tube, an upper piston seal and an outer cartridge. The outer cartridge is formed with a cartridge outlet for dispensing fluids and is configured to accept conventional mixing nozzles. Fluids are back-filled through the cartridge outlet into the inner cartridge and the outer cartridge fluid chambers. In order to prevent trapped air pockets during the filling of the fluid in the inner cartridge, one or more slots are formed in a base plate of the inner cartridge. These slots extend axially up the sidewall of the inner cartridge a short distance. The axial slots in the inner sidewall of the inner cartridge cooperate with notches formed at the mouth of the inner cartridge and axial elongated slots formed in an inner sidewall of the outer cartridge to provide an air path to atmosphere when the piston tube is in an empty position. As such, as fluid is back-filled into the inner cartridge chamber, the fluid pushes the air into the slots formed in the base of the inner cartridge. As long as the seal portion of the piston seal and delivery tube is engaged with the slots formed in the sidewall of the inner cartridge, air escapes in a direction toward the cartridge outlet and bleeds out the notches at the mouth of the inner cartridge. The elongated axial slots formed in the outer cartridge provide a vent to atmosphere. As the inner cartridge fills up with a fluid, the base of the inner cartridge moves away from the piston past the level of the slots formed in the sidewall, thus closing the vent. Accordingly any air within the inner cartridge and piston tube is vented to the atmosphere during the filling process, thus preventing trapped air pockets within the fluid to provide uniform dispensing of the product. Slots may also be formed in the outer cartridge which are configured to vent air within the outer cartridge to atmosphere.

DESCRIPTION OF THE DRAWINGS

These and other advantages of the present invention will be understood with reference to the following specification and attached drawing wherein:

FIG. 2 is a front view of a dual fluid cartridge assembly in accordance with the present invention.

FIG. 3 is a sectional view along a line 3-3 of FIG. 2, illustrating the dual fluid cartridge assembly in accordance with the present invention in a fill position.

FIG. 4 is similar to FIG. 3 but illustrating the dual fluid cartridge assembly in an empty position.

FIG. 5 is an enlarged detailed view illustrating the connection between a delivery tube and a nose outlet in accordance with the present invention.

FIG. 18 is a partial perspective view of the outer cartridge in accordance with the present invention illustrating slots for providing an air vent for the outer cartridge in accordance with another aspect of the present invention.

FIG. 19 is a plan view of an open end of the outer cartridge illustrated in FIG. 18.

FIG. 20 is an enlarged detailed view of a portion of the outer cartridge illustrating the vent slots.

DETAILED DESCRIPTION

The present invention relates dual fluid cartridge assembly for carrying two separate fluids, such as a resin and a hardener separately, which is configured to mate with a conventional mixing nozzle to enable the mixed fluids to be applied to a work piece by way of a standard calking gun. Unlike other known dual fluid cartridge assemblies, the dual fluid cartridge assembly in accordance with the present invention is configured with a vent to atmosphere which allows air in the inner cartridge to be evacuated during the fill process in order to prevent any trapped air pockets within the fluid in the inner cartridge in order to provide homogenous mixing of the dual fluids in the assembly. A vent may also be optionally provided in order to vent trapped air from the chamber formed by the outer cartridge as well.

Figure 1:
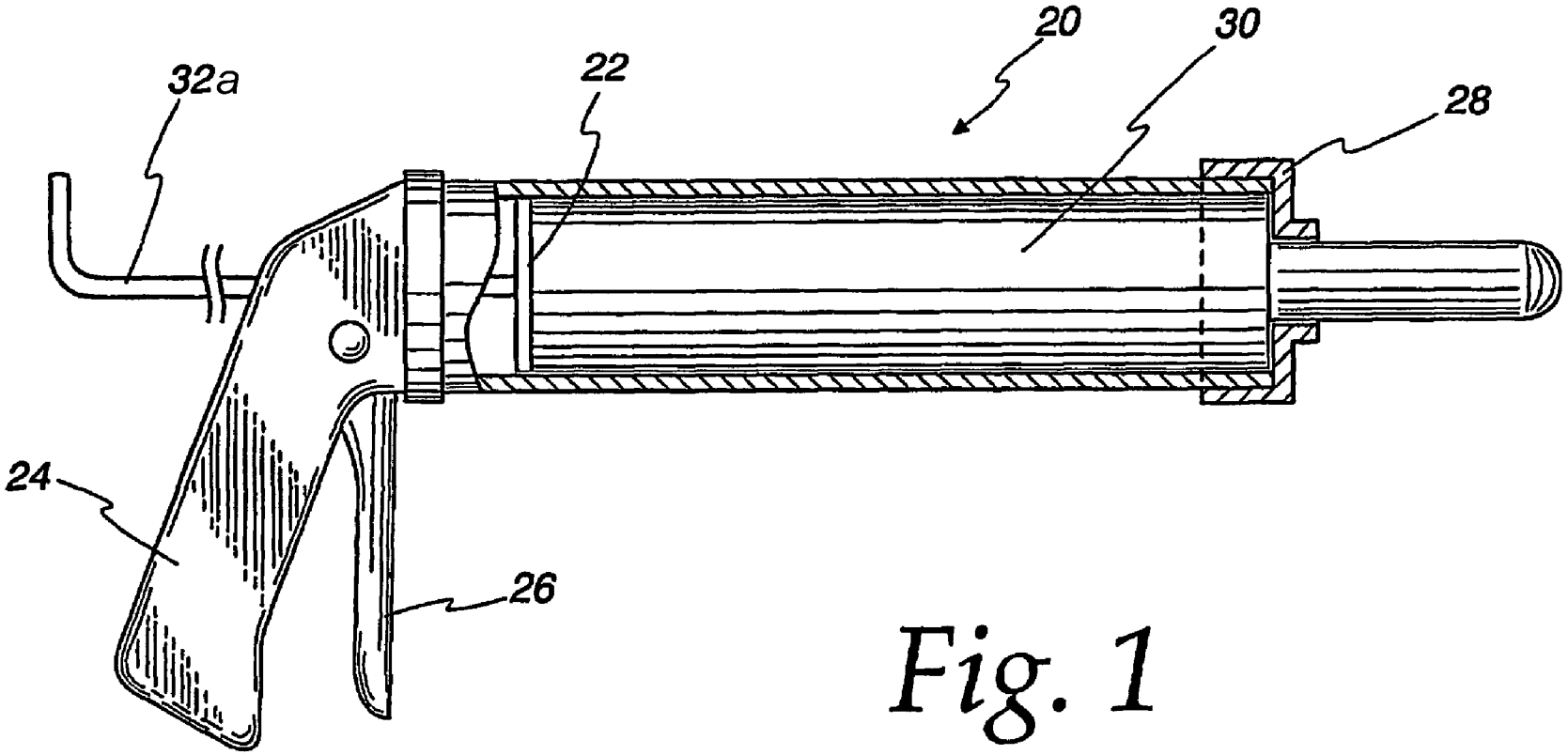
FIG. 1 is an elevational view of a conventional cartridge gun shown in partial cutaway illustrating a dual fluid cartridge assembly in accordance with the present invention.

Referring first to FIG. 1, a dual fluid cartridge assembly in accordance with the present invention is adapted to be dispensed by way of a standard caulking gun 20 which includes a plunger 22, a handle 24, a trigger 26 and a nose piece 28. The cartridge assembly in accordance with the present invention, generally identified by the reference numeral 30, is inserted into the caulking gun 20 in a conventional manner. As the trigger 26 is squeezed towards the handle 24, the plunger 22 advances in an axial direction toward the nose piece 28, assuming a ratchet arm 32*a* is in the position shown in FIG. 1. As will be discussed in more detail later, movement of the plunger 22 toward the nose 28 of the caulking gun 20 results in axial movement of an inner cartridge within an outer cartridge of the dual fluid cartridge assembly 30. This axial movement of the inner cartridge within the outer cartridge results in dispensing of the fluids and application of the fluids to a work piece by way of a cartridge outlet and a nozzle, such as a static mixing nozzle, in a similar manner as disclosed in U.S. Pat. No. 5,310,091, hereby incorporated by reference. In accordance with an important aspect of the invention, the dual fluid cartridge assembly 30 in accordance with the present invention is provided with a vent path to atmosphere which allows air in the inner cartridge and optionally the outer cartridge to be evacuated to atmosphere during filling of the inner and outer cartridges to prevent trapped air pockets therein. Such trapped air pockets are known to result in voids in the fluid in the inner and outer cartridges resulting in non-homogeneous mixing of the fluids thereby decreasing the performance of the fluids.

FIG. 3 illustrates the dual fluid cartridge assembly 30 in accordance with the present invention in a filled position, while FIG. 4 illustrates the dual fluid cartridge assembly 30 in an empty position. As shown the dual fluid cartridge assembly 30 includes an outer cartridge 32, an inner cartridge 34, an integral piston seal and delivery tube 36 having a seal portion 39; and an upper piston seal 38.

In accordance with an important aspect of the invention, a vent path to atmosphere is provided from the inner cartridge 34 when the inner cartridge 34 is in an empty position, as illustrated in FIG. 4. Filling of the inner cartridge 34 is done through a cartridge outlet 40. The cartridge outlet 40 is formed as a tubular member with an axial separator wall 41, which forms two side by side chambers for enabling filling of each of the fluids. In order to fill the inner cartridge 34, fluid is applied through the cartridge outlet 40 through the piston tube 36 into a chamber forming the inner cartridge 34, when the inner cartridge 34 is in the position shown in FIG. 4. Similarly, the outer cartridge 32 is also filled by way of the cartridge outlet 40.

Figure 6:
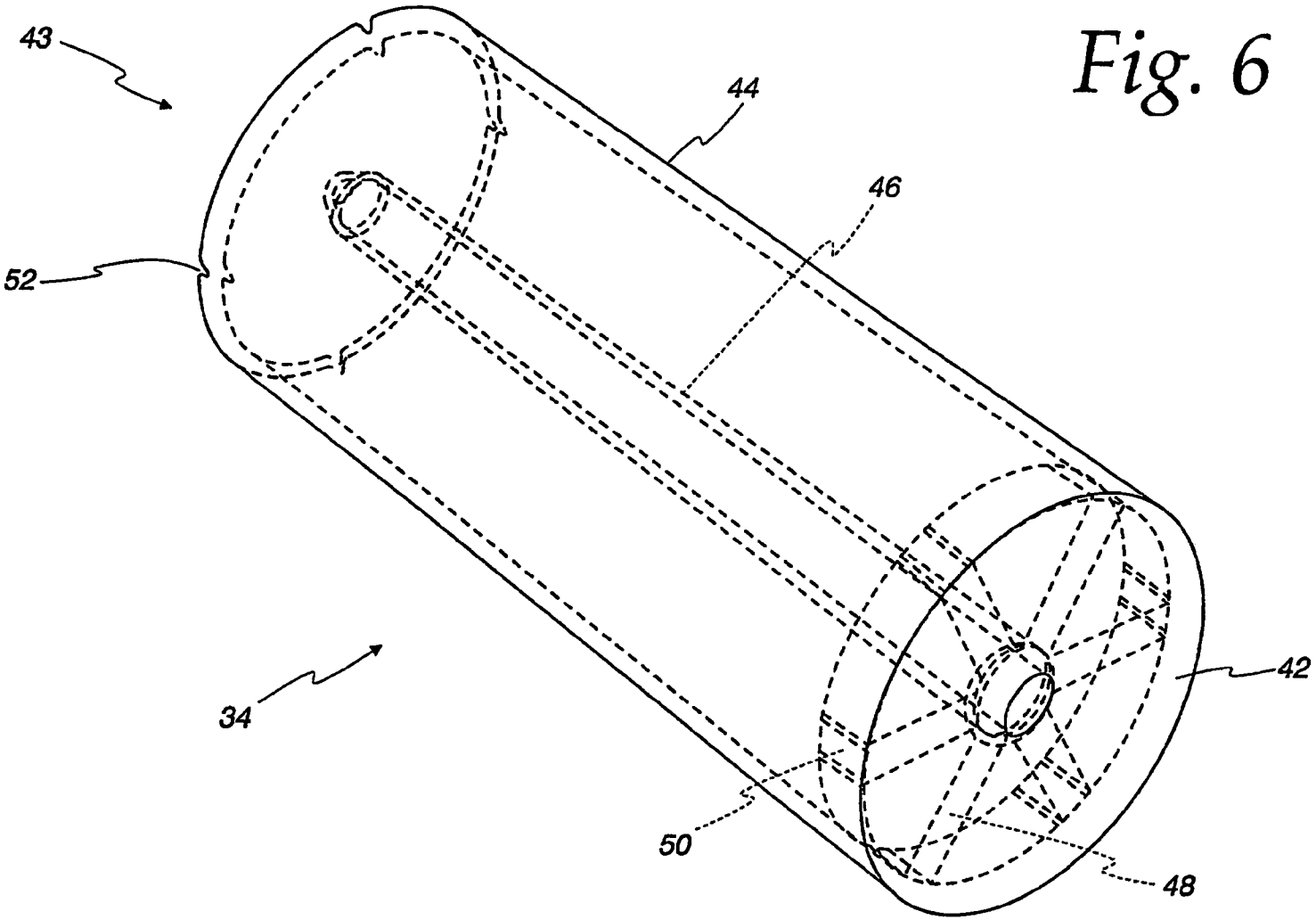
FIG. 6 is a partial simplified view of the air vent path formed in the inner cartridge in accordance with the present invention.
Figure 7:
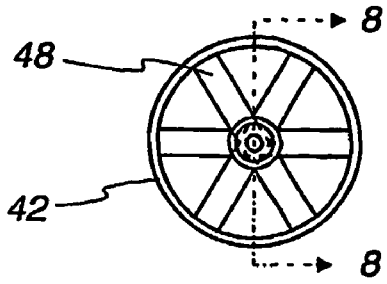
FIG. 7 is a right side view of an inner cartridge in accordance with the president invention illustrating a number of radial slots formed in a base portion of the inner cartridge.
Figure 8:
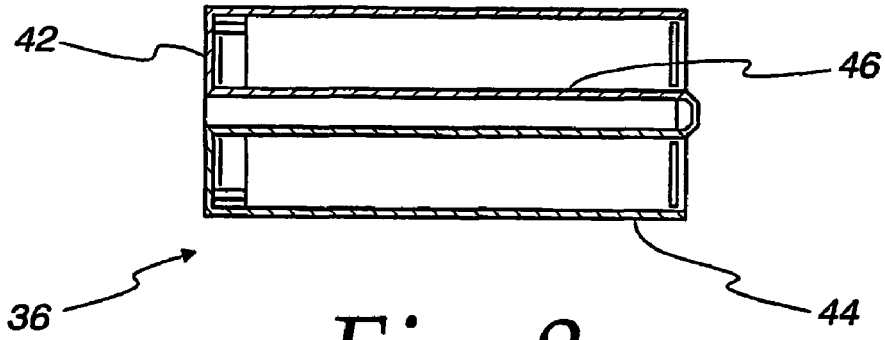
FIG. 8 is a sectional view along line 8-8 of FIG. 7 illustrating the inner cartridge in accordance with the present invention.
Figure 9:
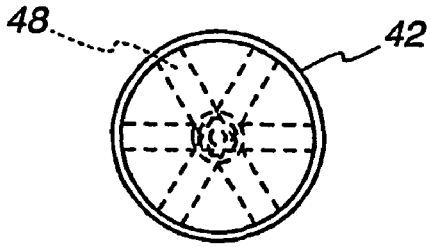
FIG. 9 is a left side view of the inner cartridge in accordance with the present invention.
Figure 11:
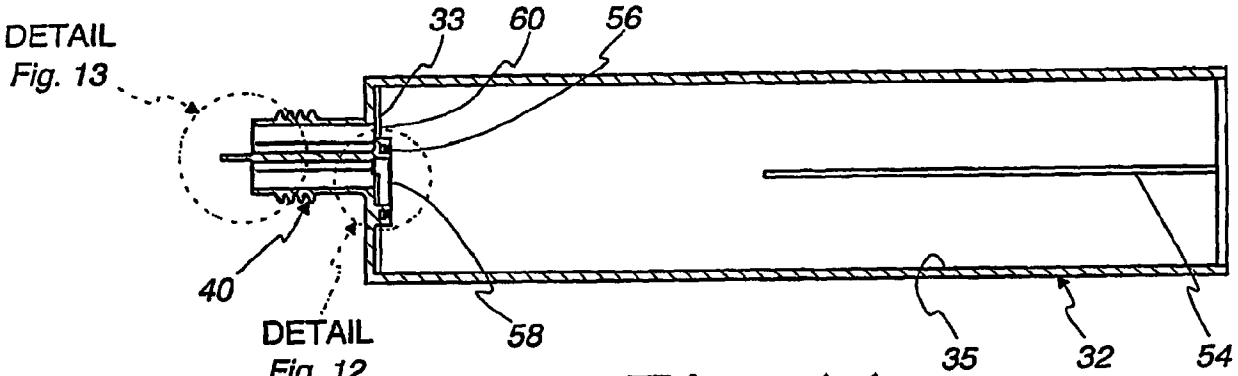
FIG. 11 is a section view along line 11-11 of FIG. 10 of the outer cartridge in accordance with the present invention.
Figure 13:
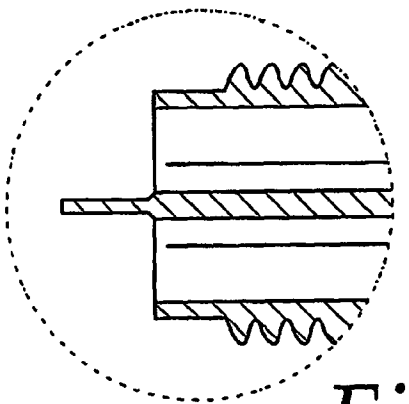
FIG. 13 is an enlarged view of the outer nose outlet portion of the outer cartridge in accordance with the present invention.

Turning to FIGS. 6-9, the inner cartridge 34 includes a circular base plate 42 and a cylindrical sidewall 44. A separator rod 46 projects upwardly from the base plate 42 and extends to a mouth 43 of the cylindrical sidewall 44 of the inner cartridge 34. In accordance with an important aspect of the invention, slots, for example, radial slots, generally identified with the reference numeral 48, are formed in the base plate 42 of the inner cartridge 34. As best shown in FIG. 6, the slots 48 formed in the base plate 42 of the inner cartridge 34 extend partially up the sidewall 44 in an axial direction, as indicated by the reference numeral 50. As best shown in FIGS. 4, 6 and 11, the slots 48 and 50 allow trapped air in the inner cartridge 34 to escape up along the sidewall 44 of the inner cartridge 34 and bleed to the outside of the inner cartridge 34 by way of one or more notches 52, formed at the mouth 43 of the inner cartridge 34. As best shown in FIG. 4 and 11, one or more axial slots 54, formed in an inner sidewall of the outer cartridge 32, allow the air from the inner cartridge 34 to escape through the axial slots 54 and out to atmosphere. As will be described in more detail below, as the seal portion 39 of the piston seal and delivery tube 36 moves away from the empty position illustrated in FIG. 4, the vent path is closed.

Figure 12:
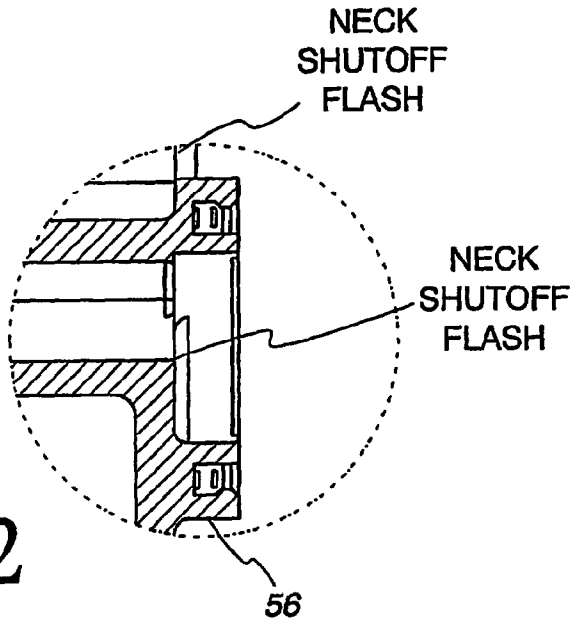
FIG. 12 is an enlarged detailed view of the inner nose outlet portion of the inner cartridge in accordance with the present invention.
Figure 10:
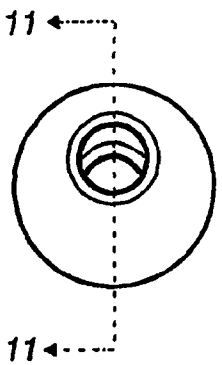
FIG. 10 is a left side view of an outer cartridge in accordance with the present invention.

FIGS. 10-13 illustrate the outer cartridge 32. As shown, the outer cartridge 32 is formed as a cylindrical member having a base plate 33 and a cylindrical sidewall 35 with a diameter slightly larger than the diameter of inner cartridge 34 to allow free axial movement of the inner cartridge 34 therewithin. The outer cartridge 32 is formed with the cartridge outlet 40 used for filling and dispensing the fluids from the inner cartridge 34 and outer cartridge 32. As shown in FIGS. 3, 5 and 12, the outer cartridge 32 includes an offset flange 56 for connection to the piston tube 36. As shown best in FIG. 5, the connection between the offset flange 56, the outer cartridge 32 and the piston seal and delivery tube 36 may be a snap connection. A delivery tube portion 37 of the piston seal and delivery tube 36 forms a conduit from the inner cartridge 34 to the nose portion 40. Fluid in the outer cartridge 32 is dispensed into an offset opening 60. Accordingly, the offset openings 58 and 60 formed along an inner wall 33 of the outer cartridge 32 together with the separator wall 41 (FIG. 2) allow the fluid from the inner cartridge 34 and the outer cartridge 32 to be discharged side by side out of the cartridge outlet 40.

Figure 14:
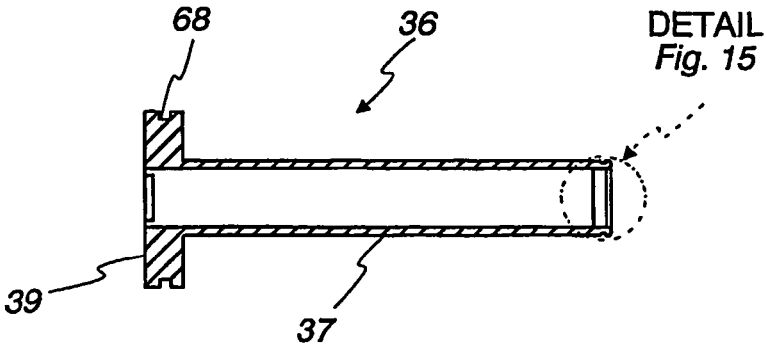
FIG. 14 is a sectional view of a piston seal and delivery tube in accordance with the present invention.
Figure 15:
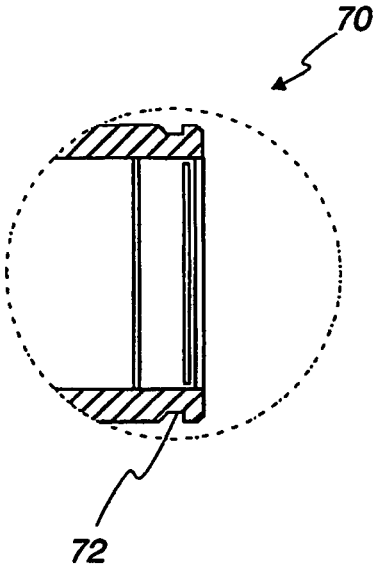
FIG. 15 is an enlarged sectional view of the one end of the delivery tube in accordance with the present invention.

FIGS. 14 and 15 illustrate the piston seal and delivery tube 36. As mentioned above, the piston seal and delivery tube 36 includes an elongated tube 37 and a lower piston seal portion 39. The lower seal portion 39 of the piston seal and delivery tube 36 may be formed, for example, with a circumferential slot 68 for receiving and an O-ring (not shown). The lower seal portion 39 seals the fluid in the inner cartridge 34 from the rest of the assembly 30. As mentioned above, an extending end 70 of the piston tube 36 may be formed with a circumferential slot 72, adjacent the extending end 70. As mentioned above and as illustrated in FIG. 5, this circumferential slot 72 cooperates with a mating slot formed in the flange 56 (FIG. 5) to provide a snap connection between the piston tube 36 and the flange 56.

Figure 16:
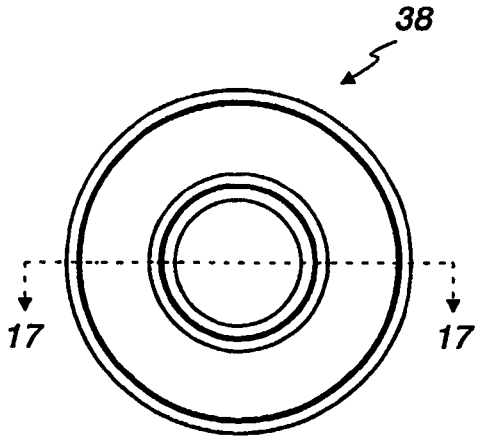
FIG. 16 is a top view of an upper piston seal for use with the present invention.
Figure 17:
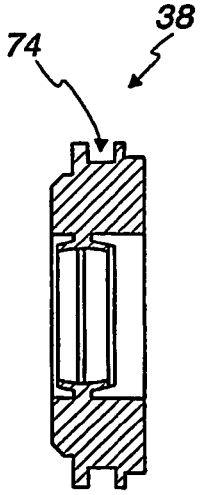
FIG. 17 is a sectional view along lines 17-17 of FIG. 16.

FIGS. 16 and 17 illustrate the upper seal 38. The upper seal 38 seals the fluid in the outer cartridge 32. As shown, the upper seal 38 may be provided with a circumferential slot 74 for receiving an O-ring (not shown). The seals 38 and 39 may alternatively be formed with equivalent configurations, such as radial extending lips or a combination of the two.

In operation, the inner cartridge 34 is filled with a fluid by way of the nose portion 40. In particular, a fill tube (not shown) is inserted in the cartridge outlet 40 and into the inlet opening 58. As discussed above, the inlet opening 58 is in fluid communication with the delivery tube portion 37 of the piston seal and delivery tube 36, which, in turn, is in fluid communication with the inner cartridge 34. When the inner cartridge 34 is in the position as shown in FIG. 4, fluid is filled through the delivery tube portion 37 toward the bottom or base portion 42 of the inner cartridge 34. In the position shown in FIG. 4, the inner cartridge vent is open to atmosphere. In particular, in this position, as fluid fills the inner cartridge 34, air is pushed into the slots 48 in the base portion 42 of the inner cartridge. As the fluid continues to fill the inner cartridge 34, air is pushed up through the axial slots 50 and bleeds out the notches 52 formed in the mouth 43 of the inner cartridge 34, as long as the seal portion 39 is not engaged with the axial slots 50. The air which bleeds from the notches 52 escapes to axial slots 54 formed in the interior sidewall of the outer cartridge 32 and out the rear of the outer cartridge 32. However, once the lower seal 39 moves below the notches 52, the vent is closed preventing fluid from being forced out through the vent.

After the inner cartridge 34 is filled, the outer cartridge 32 may be filled with a second fluid. The outer cartridge 32 is also filled through the cartridge outlet 40 but through the opening 60. After the inner cartridge 34 and outer cartridge 32 are filled, a cap (not shown) may be used to close the cartridge outlet 40 of the cartridge assembly 30.

The fluids in the cartridge assembly 30 may then be dispensed by way of a conventional caulking gun 20, as shown in FIG. 1. In operation, as the plunger 22 advances in an axial direction toward the nose piece 28 of the caulking gun 20, the inner cartridge 34 moves in an axial direction toward the nose portion 40 (FIG. 3). As the inner cartridge 34 advances in an axial direction, fluid from the inner cartridge 34 is forced into the piston tube 36 and to the nose portion 40. As the inner cartridge 34 advances in an axial direction, the upper seal 38 advances in an axial direction toward the cartridge outlet. Initially, as shown in FIG. 3, the upper seal and the piston seal 39 are side by side when the cartridge assembly 30 is full. As the inner cartridge 34 advances to the left as shown in FIG. 4, the inner cartridge 34 pushes the upper seal 38 to the left, which forces fluid in the outer cartridge 32 to be dispensed out the cartridge outlet 40.

In accordance with another aspect of the invention, the cartridge assembly 30 is optionally configured with another vent path for venting air from the outer cartridge 32 to atmosphere to avoid trapping air in the fluid carried by the outer cartridge 32. In particular with reference to FIGS. 18 through 20, one or more vent slots 80 may optionally be formed on the interior of the cylindrical sidewall 35 of the outer cartridge 32. These vent slots 80 extend from the base plate 32 (FIGS. 11 and 18) and extend in an axial direction, as shown in FIG. 18. The vent slots 80 may be disposed in a direction, for example, 180 degrees from the direction of the cartridge outlet offset, as generally shown in FIG. 18. Thus, when the upper seal 38 is in a position as shown in FIG. 4, the axial slots 80 provide a vent path around the upper seal 38 which allows air from the outer cartridge 32 to be vented by way of the axial slots 54 (FIG. 11). As soon as the upper seal 38 is out of engagement with the axial slots 80, the vent path for the outer cartridge 32 is closed.

Obviously, many modifications and variations of the present invention are possible in light of the above teachings. Thus, it is to be understood that, within the scope of the appended claims, the invention may be practiced otherwise than as specifically described above.

The invention claimed is:

1. A dual fluid cartridge assembly comprising:

(a) an outer cartridge for carrying a first fluid, said outer cartridge formed with a cartridge outlet;

(b) an upper seal for sealing said first fluid in said outer cartridge;

(c) an inner cartridge for carrying a second fluid;

(d) a piston tube for providing a fluid flow path from said inner cartridge to said cartridge outlet; and (e) a lower seal for sealing said second fluid in said inner cartridge, wherein said cartridge assembly is configured with an air vent path from said inner cartridge to atmosphere when said lower seal is in an empty position and further configured to close said vent path when said lower seal is displaced away from said empty position.

2. The dual fluid cartridge assembly as recited in claim 1, wherein said inner cartridge is formed as a cylindrical member with an open end and defining a base plate and a cylindrical sidewall.

3. The dual fluid cartridge assembly as recited in claim 2, wherein said base plate is formed with one or more base slots.

4. The dual fluid cartridge assembly as recited in claim 3, wherein said one or more base slots are radial slots.

5. The dual fluid cartridge assembly as recited in claim 4, wherein said one or more base slots are in fluid communication with one or more axial slots formed in said cylindrical sidewall of said inner cartridge.

6. The dual fluid cartridge assembly as recited in claim 5, wherein said inner cartridge is formed with one or more notches at said open end to enable air from said axial slots to bleed out of said inner cartridge.

7. The dual fluid cartridge assembly as recited in claim 1, wherein said cartridge assembly is configured with a vent to enable trapped air from said outer cartridge to be vented to atmosphere.

8. The dual fluid cartridge assembly as recited in claim 7, wherein said outer cartridge is formed with one or more axial slots to enable air from said inner cartridge to vent out of said outer cartridge.

9. The dual fluid cartridge assembly as recited in claim 7, wherein said outer cartridge is formed with a base plate and a cylindrical sidewall, said sidewall being provided with one or more slots in said cylindrical sidewall.

10. The dual fluid cartridge assembly as recited in claim 9, wherein said slots are axial slots, formed adjacent said base plate.

* * * * *